United States Patent [19]

Allenbaugh

[11] 4,139,999

[45] Feb. 20, 1979

[54] PROTECTIVE DOOR SHIELD AND LOCKING MOUNTING

[75] Inventor: Howard M. Allenbaugh, Fountain Valley, Calif.

[73] Assignee: M.A.G. Engineering Mfg. Co., Gardena, Calif.

[21] Appl. No.: 874,832

[22] Filed: Feb. 3, 1978

[51] Int. Cl.[2] ..... E05B 15/02

[52] U.S. Cl. ..... 70/452; 70/461; 292/337; 70/448

[58] Field of Search ..... 70/448, 450, 451, 452, 70/461; 292/337, 356, 357

[56] References Cited

U.S. PATENT DOCUMENTS

| | | | |
|---|---|---|---|
| 950,926 | 3/1910 | Keil | 70/452 |
| 3,673,605 | 2/1972 | Allenbaugh | 70/451 |

FOREIGN PATENT DOCUMENTS

| | | | |
|---|---|---|---|
| 1011308 | 4/1952 | France | 70/448 |
| 1481984 | 4/1967 | France | 70/452 |

*Primary Examiner*—Robert L. Wolfe

*Attorney, Agent, or Firm*—Fulwider, Patton, Rieber, Lee & Utecht

[57] ABSTRACT

A protective door shield and mounting for a lock, particularly a mortise lock or double lock, including a generally U-shaped plate that engages the swingable edge of the door in the region of the lock and a plurality of interchangeable inserts seated in openings provided in opposing side panels of the plate. Apertures in the inserts accommodate door knob shanks, lock cylinders, thumb turns and the like. The shield permits the substitution of a lock having a different arrangement of apertures without replacing the door, while it strengthens the door and provides a convenient push plate. Since the inserts are interchangeable, a standardized shield may be readily adapted for use with a wide variety of locks. The lock face plate is received by a recess in the shield and can be surrounded by a trim plate, if required.

10 Claims, 8 Drawing Figures

10
11
12
13
14
15
16
17
18
19
20
21
22
23
24
25
26
27
28
29(a)
29(b)
29(c)
30
31

PROTECTIVE DOOR SHIELD AND LOCKING MOUNTING

BACKGROUND OF THE INVENTION

The present invention relates to a protective door shield and mounting for a lock and, more particularly, to such a device that is usable with a variety of locks requiring different arrangements of apertures in the sides of the door.

The installation of door locks conventionally requires that apertures be formed in the sides of the door to accommodate door knob shanks, lock cylinders, thumb turns and the like. Mortise locks and double locks in particular employ a wide variety of aperture arrangements, often requiring two or more apertures on each side, and are not, therefore, readily installed in doors that have been cut to provide apertures for different locks. Nevertheless, because of their advantageous operational features, it is sometimes desired to use mortise or double locks as replacement equipment. If the expense of replacing the entire door is to be avoided, it is often necessary to install a U-shaped shield over the edge of the door in the region of the lock. This shield covers any unused apertures, at the same time strengthening the door and providing an attractive, convenient push plate.

The strengthening feature of the shield is particularly important because a mortise or double lock typically allows only a thin portion of the door to remain on either side, and it is, therefore, advisable to install a shield even when there are no unused openings to be covered. Shields also permit a mortise or double lock to be installed in doors made of steel and other hard to work material by cutting a simple rectangular notch that extends completely through the door instead of making a mortise cut or a more conventional double lock cut.

Only limited use has been made of shields for mortise or double locks because the variety of aperture arrangements has so far effectively prevented mass production. A primary objective of the present invention is to provide such a shield that is readily adaptable for use with many different locks, mortise and double locks in particular, and can, therefore, be manufactured in economical quantities.

SUMMARY OF THE INVENTION

The present invention resides in a protective door shield and lock mounting including one or more easily installed inserts by which it can be adapted for use with a wide variety of locks. Formed by a generally U-shaped plate having an elongated center section and two opposing side panels, the plate snugly engages the swingable edge of a door. A front opening in the center section permits a lock bolt to extend from the door and engage a striker plate in the conventional manner. The inserts are retained within openings in the side panels and provide apeartures for lock operators, such as door knob shanks and lock cylinders.

A variety of interchangeable inserts can be used with a single shield providing the desired versatility. Moreover, blind inserts are readily handled workpieces in which any desired combination of apertures can be custom formed to suit a particular lock.

In one form of the invention, the front opening is generally rectangular to receive the face plate of the lock, which is secured to brackets recessed within the opening. The side openings are also preferably rectangular to engage inserts having raised portions that fit within the openings and peripheral flanges that extend beneath the surrounding portions of the side panels. The lock face plate can be received by a recess in the shield and if necessary, is surrounded by a trim plate.

Other features and advantages of the present invention will become apparent from the following detailed description, taken in conjunction with the accompaying drawings which illustrate, by way of example, the principles of the invention.

DESCRIPTION OF THE PREFERRED EMBODIMENT

Figures 1, 2, 3, 4, 5:
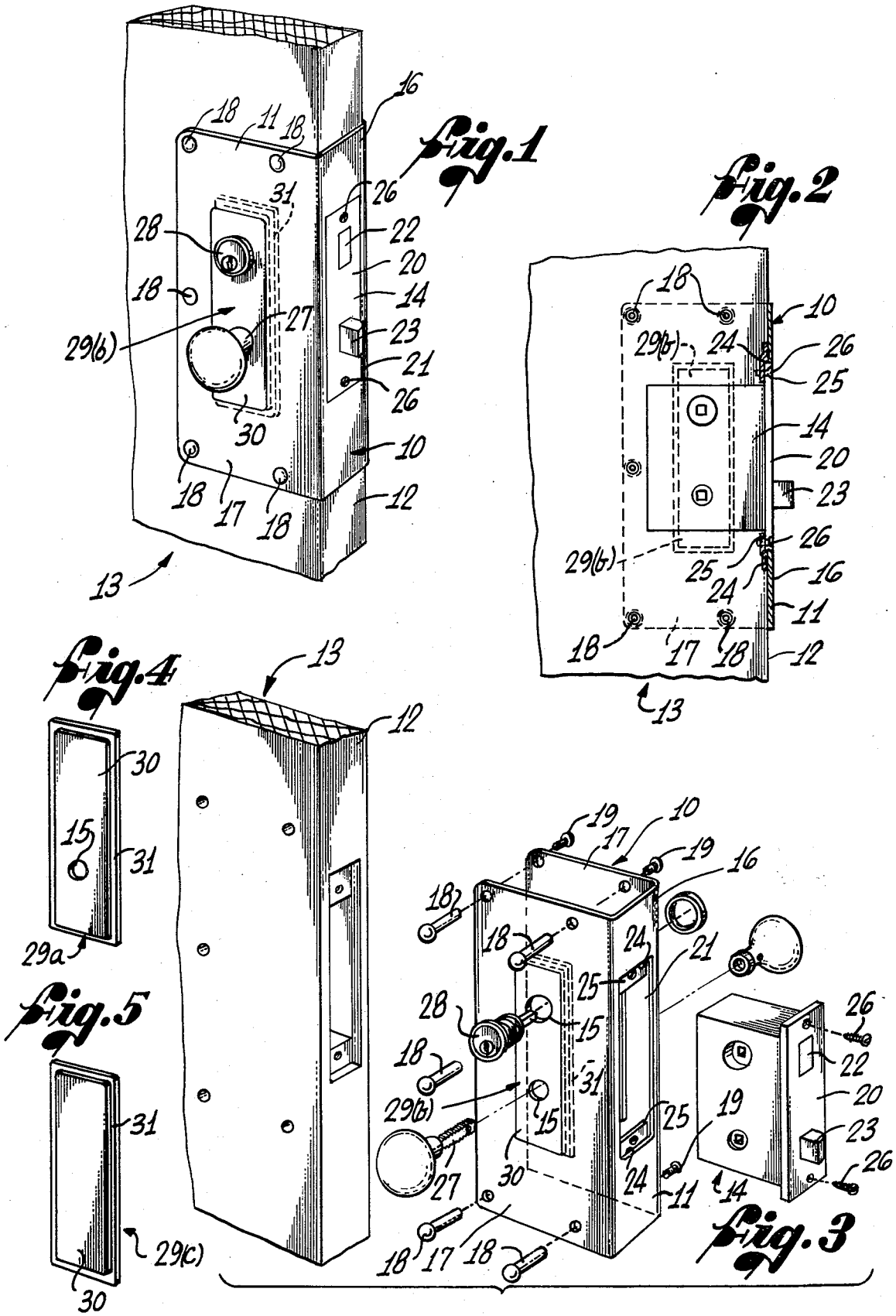
FIG. 1 is a perspective view of a fragmentary portion of a door in which a mortise lock has been installed, a protective door shield that embodies many features of the present invention providing a mounting for the lock.
FIG. 2 is a sectional view of the door, lock and shield of FIG. 1.
FIG. 3 is an exploded view of the door, lock and shield.
FIGS. 4 and 5 are perspective views of various interchangeable inserts usable with the shield in FIG. 1.
Figure 6:
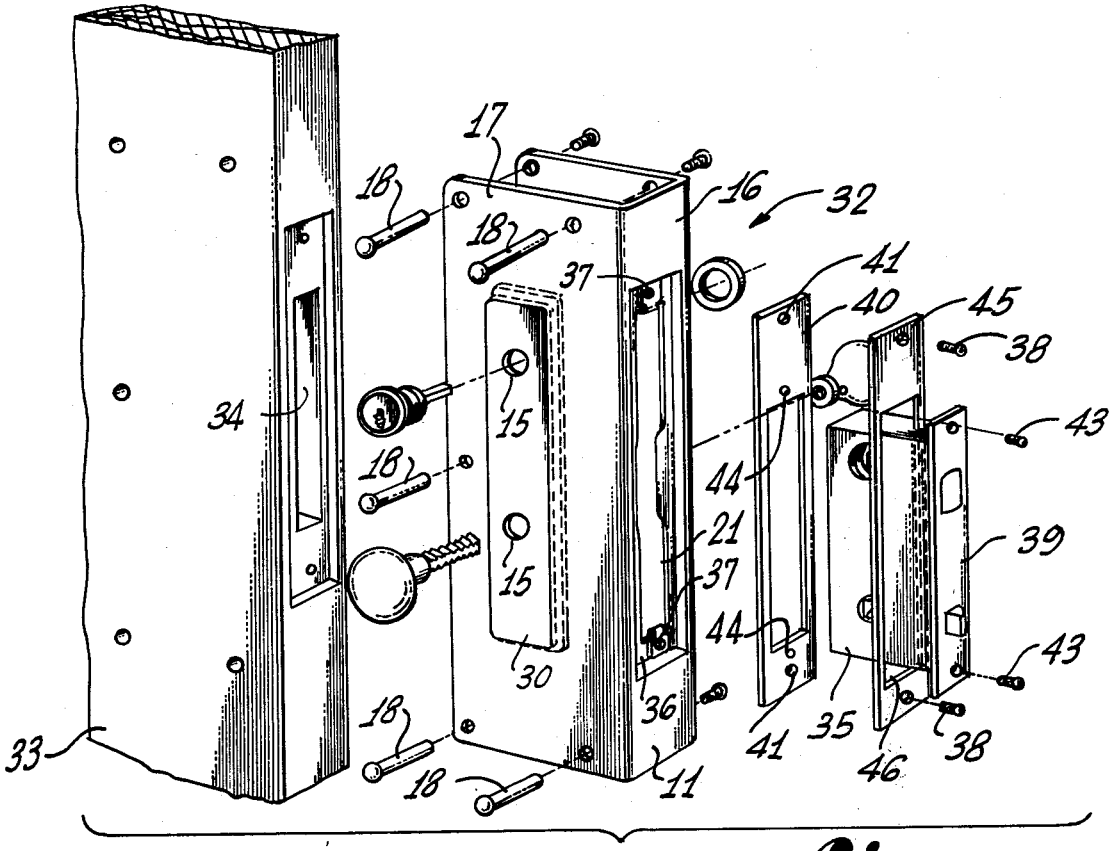
FIG. 6 is an exploded view of another door, lock and shield that embodies many features of the invention.
Figure 7:
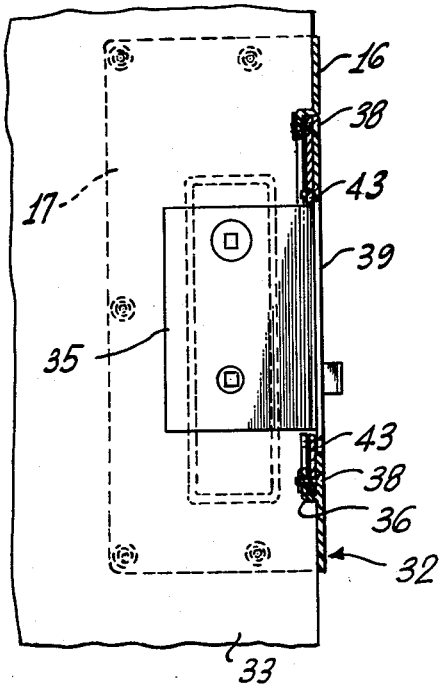
FIG. 7 is a sectional view of the door, lock and shield of FIG. 6.
Figure 8:
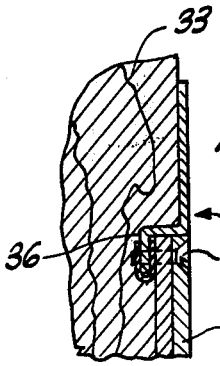
FIG. 8 is an enlarged sectional view of a fragmentary portion of the door and shield of FIG. 6.

An exemplary protective door shield and lock mounting 10 that embodies many novel features of the present invention is illustrated in FIGS. 1–5 of the accompanying drawings. This shield includes a U-shaped plate 11 that engages the swingable edge 12 of a door 13 in the region of a conventional mortise lock 14 and provides various side apertures 15 in an appropriate arrangement.

The plate 11 includes a vertically elongated, rectangular, center section 16 having two parallel, vertical edges and two generally rectangular, integrally formed, side panels 17 that extend perpendicularly from the vertical edges. When the door 13 is snugly received within the plate, the side panels overlie the sides of the door while the center section abuts the edge 12. Five internally threaded bolts 18 extend through the door to hold the side panels inwardly, each through bolt being engaged on the opposite side by an externally threaded screw 19. The bolts are long enough that when fully tightened they will not crush a hollow door.

The face plate 20 of the lock 14 is mounted within a vertically elongated, rectangular front opening 21 in the center section 16, the exterior surface of the face plate being flush with the shield 10. When the lock 14 is operated, two lock bolts 22 and 23 project from the face plate 20, through the front opening to engage a conventional striker plate (not shown).

The face plate 20 is secured to the shield 10 by two brackets 24 extending from the top and bottom of the center section 16. Each bracket is welded at one end to the inner surface of the center section, its opposite end, which is offset into the interior of the door 13, forming an attachment section 25 that is recessed behind one end of the front opening 21, as best shown in FIG. 2. Two screws 26 secure the face plate to the brackets 24 so that the lock 14 and shield 10 form a single, unitary structure.

It is necessary for the apertures 15 in the side plates 17 to accommodate door knob shanks 27, turn bolts (not shown), lock cylinders 28 and the like, as most clearly illustrated in FIG. 3. Although the number, size shape and location of these operator apertures varies widely from one lock to another, the shield 10 of the present invention can readily accommodate many different locks including mortise locks (as shown) and double locks. This flexibility is achieved by the use of a pair of interchangeable inserts 29 received within generally rectangular, vertically elongated, side openings, one in each side panel 17. The two side openings are of the same configuration and are aligned with each other.

Each interchangeable insert 29 includes a raised, generally rectangular, center portion 30, as best shown in FIGS. 4 and 5, shaped and dimensioned to be received by either of the side openings 21. With the insert seated in the appropriate opening, the center portion projects to a level at which it is flush with or is slightly above the outer surface of the surrounding panel 17 and a peripheral, depending flange 31, parallel to the center portion, extends beneath the underside of the panel.

A variety of preformed inserts such as 29(*a*) and 29(*b*) are made available, commonly having one (FIG. 4), two (FIGS. 1–3) or more apertures 15 in the required configuration. The majority of locks can be accommodated by selecting from this assortment of stock parts. Blind inserts 29(*c*) (FIG. 5) are also provided which can be used where no apertures are required and, because they are relatively flat and, therefore, relatively easy to work with, they can readily be cut to provide the apertures 15 as required, giving the invention even greater flexibility.

A second protective door shield and lock mounting 92 that embodies many features of the invention is shown in FIGS. 6–9. It is used in conjunction with a door 33 having a mortise cut 34 and an exemplary mortise lock 35 (although it would be equally suitable for use with a double lock). Since the second shield 32 is similar to the first shield 10 in many respects, corresponding portions and components of the second shield that do not differ from those of the first are indicated by the same reference numbers and are not described again.

In the second shield 32, brackets for attaching the face plate of the lock are formed by a lip 36, integrally formed with the center section 11. The lip 36 is stamped from the same metal sheet as the center section 11 and side panels 17, and is recessed behind the front opening 21 extending about the entire perimeter of the opening. At the top and bottom ends of the opening 21 are clips 37 that are threaded to receive screws 38, the holes in the clips being aligned with a pair of holes in the lip 36, the holes being slightly elongated vertically to allow adjustment of the position of the clips 37.

The lock 35 has a face plate 39 smaller than the preformed front opening 21 of the center section 16 and does not span the distance between the clips 37. It, therefore, requires an adapter plate 40, which is a rectangular metal plate approximately the same size as the front opening 21. It has a set of outer holes 41 aligned with the clips 37 to receive fastening screws 38. The lock 35 is inserted through a central opening 42 in the adapter plate 40 and the face plate 39 is attached by screws 43 received in a set of inner holes 44 in the adapter plate 40. The lip 36 is recessed enough to accommodate both the adapter plate 40 and the face plate 39.

Although the exposed surface of the face plate 39 is flush with the enter section 16, the face plate is considerably smaller than the front opening 21. To give the door 33 a finished appearance, a trim plate 45 that surrounds the face plate 39 is positioned within the front opening 21 overlying the adapter plate 40. The trim plate 45 is of the same size as the front opening 21. It has a rectangular central opening 46 that receives the face plate 39 and is secured by the same two fastening screws 38 that secure the adapter plate 40.

While the trim plate 45 described above completely surrounds the face plate 39, there may be situations in which the face plate is of the proper width but not the proper length for the front opening 21. In that case, two relatively small trim plates may be used, one at the top of the front opening 21 and one at the bottom.

It will be understood from the foregoing that the present invention permits the mass production of door shields that are usable with a great variety of locks. It permits free substitution of locks without door replacement and provides added strength in situations where custom-made and, therefore, considerably more costly shields would otherwise have been required. While a particular form of the invention has been illustrated and described, it will be apparent that various modifications can be made without departing from the spirit and scope of the invention.

I claim:

1. A protective door shield and lock mounting comprising:

a U-shaped metal plate having a center section with two parallel edges and two generally rectangular side panels that are integrally formed with said center section and extend perpendicularly thereto, whereby said plate is adapted to snugly engage the edge of a door in the region of said lock with said side panels overlying opposite sides of said door;

an enlongated, rectangular, front opening in said center section to receive the face plate of said lock;

a lip integrally formed with said center section and recessed behind said opening;

an adapter plate disposed within said opening;

at least one trim plate at least partially surrounding said face plate and overlying said adapter plate;

means for securing said adapter plate and said trim plate to said lip;

means for securing said face plate to said adapter plate;

a plurality of bolts extending through and connecting said side panels;

a vertically elongated, generally rectangular side opening in each of said side panels, said openings having substantially the same shape and dimensions and being aligned with each other; and a plurality of interchangeable inserts shaped and dimensioned to be seated in said side openings, each of said inserts having a raised generally rectangular center portion and a depending peripheral flange for engaging the underside of one of said side panels in the area surrounding said side opening, at least one of said inserts having an aperture therein to accommodate said lock.

2. A protective door shield and lock mounting comprising:

a U-shaped metal plate having a center section with two parallel edges and two generally rectangular side panels that are integrally formed with said center section and extend perpendicularly thereto, whereby said plate is adapted to snugly engage the edge of a door in the region of said lock with said side panels overlying opposite sides of said door;

an enlongated, rectangular, front opening in said center section to receive the face plate of said lock;

a pair of brackets extending from said center section at opposite ends of said front opening, each of said brackets having an offset attachment section extending into alignment with said front opening for attachment to the face plate of a lock;

a plurality of bolts extending through and connecting said side panels;

a vertically elongated, generally rectangular side opening in each of said side panels, said openings having substantially the same shape and dimensions and being aligned with each other; and a plurality of interchangeable inserts shaped and dimensioned to be seated in said side openings, each of said inserts having a raised generally rectangular center portion and a depending peripheral flange for engaging the underside of one of said side panels in the area surrounding said side opening, at least one of said inserts having an aperture therein to accommodate said lock.

3. A protective door shield and lock mounting comprising:

a generally U-shaped plate having an elongated center section with two parallel edges and two side panels that are integrally formed with said center section and extend from said edges perpendicular to said center section, whereby said plate is adapted to engage an edge of a door in the region of said lock with said side panels overlying opposite sides of said door;

a front opening in said center section to permit a lock bolt to extend from said door;

a side opening provided in at least one of said side panels; and at least one insert adapted to be seated in said side opening and engaged by one of said side panels, said insert having at least one aperture therein to accommodate said lock.

4. The device of claim 3 wherein said insert comprises a raised center portion shaped and dimensioned to be received within said side opening and a peripheral flange for engaging the underside of one of said side panels in the area surrounding said side opening.

5. The device of claim 4 wherein said raised center portion and said side opening are generally rectangular.

6. The device of claim 3 wherein each of said side panels has a side opening, there being an insert corresponding to each of said side openings.

7. The device of claim 6 wherein said side openings are of the same size and shape and said inserts are interchangeable.

8. The device of claim 3 further comprising bracket means secured to said plate and extending into alignment with said front opening for attachment to the face plate of a lock.

9. The device of claim 3 further comprising a pair of bracket portions carried by said center section at opposite ends of said front opening, each of said bracket portions having an offset attachment section extending into alignment with said front opening for attachment to the face plate of a lock.

10. The device of claim 3 comprising:

a lip integrally formed with said center section and recessed behind said opening;

an adapter plate disposed with said opening;

at least one trim plate at least partially surrounding said face plate and overlying said adapter plate;

means for securing said adapter plate and said trim plate to said lip; and means for securing said face plate of a lock to said adapter plate.

* * * * *